US008876269B2

(12) United States Patent
Hirano

(10) Patent No.: US 8,876,269 B2
(45) Date of Patent: Nov. 4, 2014

(54) INKJET RECORDING DEVICE, COMPUTER PROGRAM FOR CONTROLLING THE SAME, AND METHOD OF USING THE SAME

(75) Inventor: Taeko Hirano, Shizuoka (JP)

(73) Assignee: Roland DG Corporation, Shizuoka (JP)

( * ) Notice: Subject to any disclaimer, the term of this patent is extended or adjusted under 35 U.S.C. 154(b) by 85 days.

(21) Appl. No.: 13/393,487

(22) PCT Filed: Dec. 25, 2009

(86) PCT No.: PCT/JP2009/071677
§ 371 (c)(1),
(2), (4) Date: Feb. 29, 2012

(87) PCT Pub. No.: WO2011/024328
PCT Pub. Date: Mar. 3, 2011

(65) Prior Publication Data

US 2013/0021396 A1 Jan. 24, 2013

(30) Foreign Application Priority Data

Aug. 31, 2009 (JP) ..... 2009-201121
Nov. 3, 2009 (JP) ..... 2009-252526

(51) Int. Cl.

| | |
|---|---|
| ***B41J 2/18*** | (2006.01) |
| ***B41J 2/21*** | (2006.01) |
| *B41J 2/165* | (2006.01) |
| *B41J 2/17* | (2006.01) |
| *B41J 2/175* | (2006.01) |
| *B41J 29/38* | (2006.01) |

(52) U.S. Cl.
CPC ..... *B41J 2/175* (2013.01); *B41J 2/17596* (2013.01); *B41J 2/16532* (2013.01); *B41J 2/1707* (2013.01); *B41J 2/2117* (2013.01)
USPC ..... 347/89; 347/6; 347/22; 347/84; 347/85

(58) Field of Classification Search
USPC ..... 347/6, 22, 89, 84, 85
See application file for complete search history.

(56) References Cited

U.S. PATENT DOCUMENTS 4,380,770 A * 4/1983 Maruyama ..... 347/29
6,951,382 B2 * 10/2005 Inui et al. ..... 347/37
(Continued)

FOREIGN PATENT DOCUMENTS

JP 04251752 A * 9/1992 ..... B41J 2/175
JP 06-008465 A 1/1994
(Continued)

OTHER PUBLICATIONS

International Search Report for PCT/JP2009/071677 dated Feb. 9, 2012, pp. 1-2.

*Primary Examiner* — Laura Martin
*Assistant Examiner* — Jeremy Bishop
(74) *Attorney, Agent, or Firm* — Ditthavong & Steiner, P.C.

(57) ABSTRACT

An inkjet printer (100) has an ink tank (113), an ink head (110), an ink supply tube (112) configured to supply ink from the ink tank (113) to the ink head (110), an ink return tube (115) one end of which is connected to an upstream side portion of the ink supply tube (112) and the other end of which is connected to a downstream side portion of the ink supply tube (112), and a pump (116) configured to circulate the ink in the ink supply tube (112) and the ink return tube (115).

10 Claims, 7 Drawing Sheets

(56) References Cited

U.S. PATENT DOCUMENTS

| | | | | |
|---|---|---|---|---|
| 7,140,724 | B2 * | 11/2006 | Otis et al. | 347/89 |
| 7,311,389 | B1 * | 12/2007 | Pidgeon | 347/89 |
| 2008/0239027 | A1 | 10/2008 | Kinase et al. | |
| 2009/0002467 | A1 * | 1/2009 | Watanabe | 347/89 |

FOREIGN PATENT DOCUMENTS

| | | | | | |
|---|---|---|---|---|---|
| JP | 06183024 | A | * | 7/1994 | B41J 2/175 |
| JP | 11-320912 | A | | 11/1999 | |
| JP | 2002-029041 | A | | 1/2002 | |
| JP | 2008-264767 | A | | 6/2008 | |

* cited by examiner

| Time | 0-8 hrs. | 8-72 hrs. | 72 hrs. or longer |
|---|---|---|---|
| Ink discharge amount | 0 cc | 6.5 cc | 9 cc |

INKJET RECORDING DEVICE, COMPUTER PROGRAM FOR CONTROLLING THE SAME, AND METHOD OF USING THE SAME

TECHNICAL FIELD

The present invention relates to an inkjet recording device, a computer program for controlling the inkjet recording device, and a method of using the inkjet recording device.

BACKGROUND ART

An inkjet recording device having an ink head for ejecting ink and an ink tank for storing ink is conventionally known. In this kind of inkjet recording device, an ink supply path is provided between an ink tank and an ink head (see Patent Documents 1 and 2). The ink in the ink tank is supplied to the ink head through the ink supply path.

CITATION LIST

Patent Literature

[Patent Document 1] JP 2002-29041 A
[Patent Document 2] JP H06 (1994)-8465 A

SUMMARY OF INVENTION

Technical Problem

In this type of inkjet recording device, the coloring material contained in the ink may sometimes settle in the ink supply path while the device is not operating. If the coloring material settles, however, the concentration of the ink inside the ink supply path will change, degrading the printing quality of the inkjet recording device. In addition, if the coloring material keeps settling for a long time, the settling coloring material may be hardened inside the ink supply path. This may cause the hardened coloring material to choke the ink supply path or the nozzles in the ink head, further degrading the printing quality of the inkjet recording device.

The present invention has been accomplished in view of the foregoing and other problems, and it is an object of the invention to inhibit degradation of the printing quality that is caused by the settling of the coloring material of the ink inside the ink supply path.

Solution to Problem

The present invention provides an inkjet recording device comprising: an ink tank configured to store ink; an ink head configured to eject the ink; an ink supply path having an upstream end connected to the ink tank and a downstream end connected to the ink head, the ink supply path connecting the ink tank and the ink head to each other; an ink return path, one end of which being connected to the ink supply path at a location nearer the upstream end than a mid-position of the ink supply path and the other end of which being connected to the ink supply path at a location nearer the downstream end than the mid-position of the ink supply path; and a pump configured to circulate the ink through the ink supply path and the ink return path.

The invention also provides a computer program for controlling the above-described inkjet recording device having a control device for controlling the ink head and the pump, the computer program configured to operate the control device so as to drive the pump before the ink head ejects the ink for printing.

The present invention provides a method of using the above-described inkjet recording device, the method comprising the steps of: driving the pump to circulate the ink; and allowing, after driving the pump in the step of driving, the ink head to eject the ink for printing.

Advantageous Effects of Invention

The present invention makes it possible to inhibit the degradation of the printing quality resulting from the settling of the coloring material of the ink in the ink supply tube.

REFERENCE SIGNS LIST

100 Inkjet printer (inkjet recording apparatus)
110 Ink head
113 Ink tank
112 Ink supply tube
114*a*, 114*b* Three-way valve
115 Ink return tube (ink return path)
116 Pump
120 Controller (control device)

DESCRIPTION OF EMBODIMENTS

Figure 1:
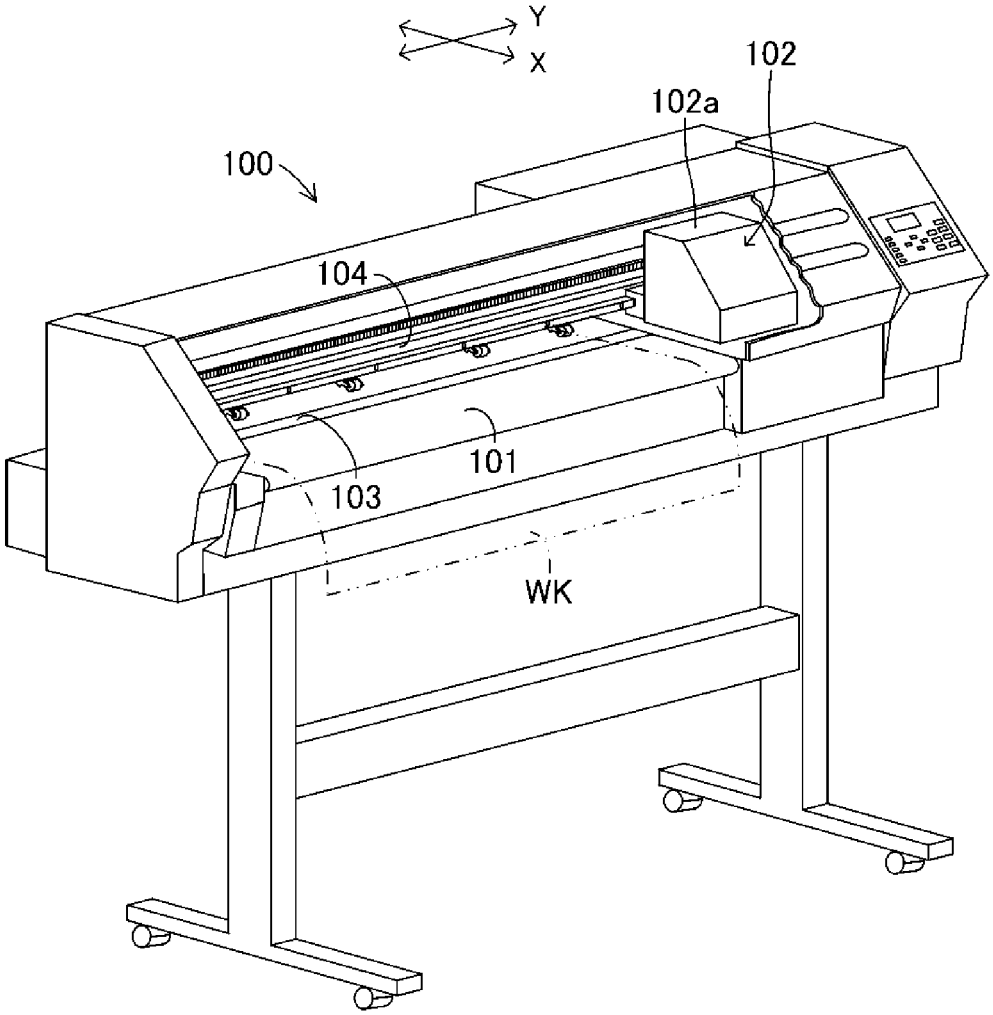
FIG. 1 is a perspective view illustrating an inkjet printer.

As illustrated in FIG. 1, an inkjet recording device according to the present embodiment is an inkjet printer 100. The inkjet printer 100 has a platen 101 for supporting a recording medium WK such as paper, and an ink head unit 102 disposed above the platen 101. The ink head unit 102 ejects ink droplets onto the recording medium WK, so that an image of desired characters, symbols, or graphics, for example, is formed on the recording medium WK. The platen 101 is provided with a cylindrical grid roller 103. The grid roller 103 is driven by a feed motor (not shown). The feed motor is controlled by a later-described controller 120 (see FIG. 2). By rotation of the grid roller 103, the recording medium WK is delivered in a secondary scanning direction. In the present embodiment, the secondary scanning direction is the front-rear direction. Reference character X in the figure indicates the secondary scanning direction.

The inkjet printer 100 has a long guide rail 104 extending along a primary scanning direction. In the present embodiment, the primary scanning direction is a left-right direction. Reference character Y in the figure indicates the primary scanning direction. The ink head unit 102 is slidably supported by the guide rail 104. The ink head unit 102 is moved in the primary scanning direction by a scan motor (not shown). This scan motor is controlled by the controller 120.

Figure 2:
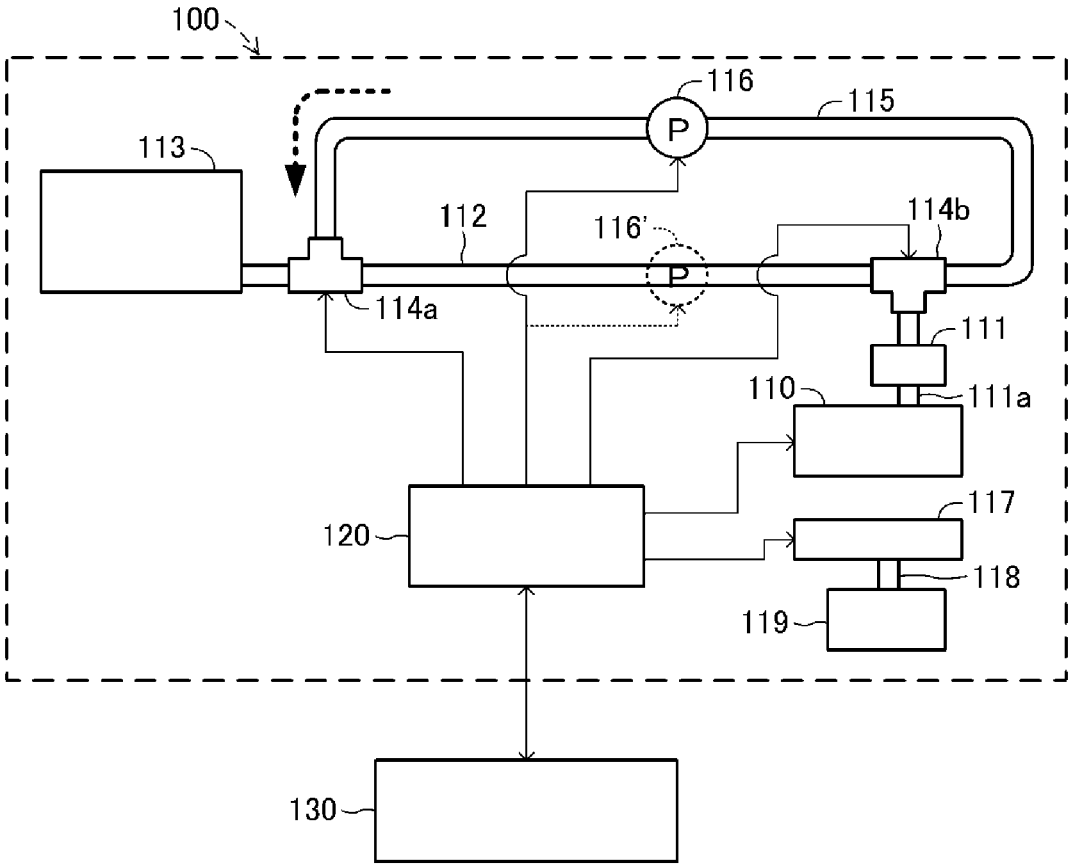
FIG. 2 is a conceptual view illustrating an ink supply system for white ink.

The ink head unit 102 has a case 102*a* formed in a box shape and six ink heads 110 (see FIG. 2; note that FIG. 2 depicts only one ink head 110 of the six ink heads 110) disposed in the case 102*a*. The six ink heads 110 eject inks of different colors from each other. In the present embodiment, the six ink heads 110 respectively discharge white, cyan, magenta, yellow, black, and transparent inks. These ink heads 110 have almost the same configuration. Each of the ink heads 110 has a plurality of nozzles, which are not shown in the drawings. The nozzles are arrayed along the secondary scanning direction.

Respective ink supply systems are provided for the respective inks. FIG. 2 is a conceptual view illustrating the ink supply system for the white ink. The ink supply systems for the other inks are different from the ink supply system for white ink in the respect that they do not have an ink return tube 115, a pump 116, and three-way valves 114*a* and 114*b*, which are described later, but the same in other respects as the ink supply system for white ink. For this reason, the description of the ink supply systems for the other inks will be omitted.

As illustrated in FIG. 2, the ink head 110 is connected to an ink tank 113 via a lead-in tube 111*a*, a sub-tank 111, and an ink supply tube 112. The sub-tank 111 is a container for temporarily storing the ink that is to be supplied to the ink head 110. The sub-tank 111 is connected to the ink head 110 via the lead-in tube 111*a*. The sub-tank 111 is also connected to the ink tank 113 via the ink supply tube 112. The ink supply tube 112 is constructed by a tube made of a resin. The construction of the ink supply tube 112 is, however, not particularly limited. The ink supply tube 112, the sub-tank 111, and the lead-in tube 111*a* correspond to the ink supply path of the present invention. Although not shown in the drawings, the ink tank 113 is detachably fitted to the back face of the inkjet printer 100.

A three-way valve 114*a* is provided at a portion of the ink supply tube 112 near the ink tank 113, that is, at an upstream side portion of the ink supply tube 112. One end of an ink return tube 115 is connected to the three-way valve 114*a*. A three-way valve 114*b* is provided at a portion of the ink supply tube 112 near the sub-tank 111, that is, at a downstream side portion of the ink supply tube 112. The other end of the ink return tube 115 is connected to the three-way valve 114*b*. Each of the three-way valves 114*a* and 114*b* is constructed by a three-way solenoid valve. The construction of each of the three-way valves 114*a* and 114*b* is, however, not particularly limited. The three-way valves 114*a* and 114*b* are controlled by the controller 120. Where a port of the three-way valve 114*a* on the ink tank 113 side, a port thereof on the three-way valve 114*b* side, and a port thereof connected to the ink return tube 115 are respectively referred to as the first port, the second port, and the third port, the three-way valve 114*a* is freely switchable between a state in which the first port and the second port are in communication with each other and a state in which the second port and the third port are in communication with each other. Where a port of the three-way valve 114*b* on the three-way valve 114*a* side, a port thereof on the sub-tank 111 side, and a port thereof connected to the ink return tube 115 are respectively referred to as the first port, the second port, and the third port, the three-way valve 114*a* is freely switchable between a state in which the first port and the second port are in communication with each other and a state in which the first port and the third port are in communication with each other.

The ink return tube 115 is formed of a tube made of a resin. The construction of the ink return tube 115 is, however, not particularly limited. As described above, the ink supply tube 112, the sub-tank 111, and the lead-in tube 111*a* constitute the ink supply path for supplying the ink inside the ink tank 113 to the ink head 110. The ink return tube 115 causes the ink inside the ink supply path to circulate through the ink return tube 115. One end of the ink return tube 115 is connected to the ink supply path nearer the upstream side than the mid-position thereof, while the other end of the ink return tube 115 is connected to the ink supply path nearer the downstream side than the mid-position of the ink supply path. Particularly in the present embodiment, in order to circulate the ink over a wide area of the ink supply path, one end of the ink return tube 115 is connected to a portion near the upstream end of the ink supply tube 112, and the other end of the ink return tube 115 is connected to a portion near the downstream end of the ink supply tube 112. This ink return tube 115 corresponds to the ink return path of the present invention. A pump 116 is provided for the ink return tube 115. The pump 116 is constructed by what is called a tube pump and is controlled by the controller 120. The delivering direction of the ink by the pump 116 is not particularly limited. In the present embodiment, the pump 116 is configured to deliver ink from the three-way valve 114*b* toward the three-way valve 114*a*, as indicated by the dashed line arrow in FIG. 2.

A cleaning unit 117 is provided in the platen 101. The cleaning unit 117 is disposed so as to face the ink head 110. The cleaning unit 117 is a device for removing unnecessary ink from the ink head 110 by sucking the ink adhering to the nozzle surface of the ink head 110 or the dried ink in the nozzles. The cleaning unit 117 is also controlled by the controller 120. A waste liquid tank 119 is connected to the cleaning unit 117 via a connecting tube 118. The waste liquid tank 119 is a container for storing the ink collected by the cleaning unit 117.

The controller 120 is constructed by a microcomputer having, for example, a CPU, a ROM, and a RAM. A computer 130 is connected to the controller 120 via an interface, which is not shown in the drawings. The controller 120 controls various kinds of operations of the inkjet printer 100 by executing a program pre-stored in a storage device, such as the ROM, in response to an instruction from the user or an instruction from the computer 130. Specifically, the controller 120 controls the feed motor, the scan motor, the ink head 110, the three-way valves 114*a*, 114*b*, the pump 116, and the cleaning unit 117. The computer 130 includes a personal computer equipped with an input device (not shown) including a keyboard and a mouse, and a displace device (not shown) including a liquid crystal display.

Next, an ink circulation process in the inkjet printer 100 will be described. The print operation of the inkjet printer 100 on the recording medium WK is conventionally known, and therefore the description thereof will be omitted here.

When the user turns ON a main power switch, which is not shown in the drawings, the controller 120 executes a predetermined control program. The controller 120 positions the ink head unit 102 at an initial position, and enters a stand-by state, in which it waits for an instruction from the computer 130. Then, the following pre-printing ink circulation process is executed.

Figures 3, 4:
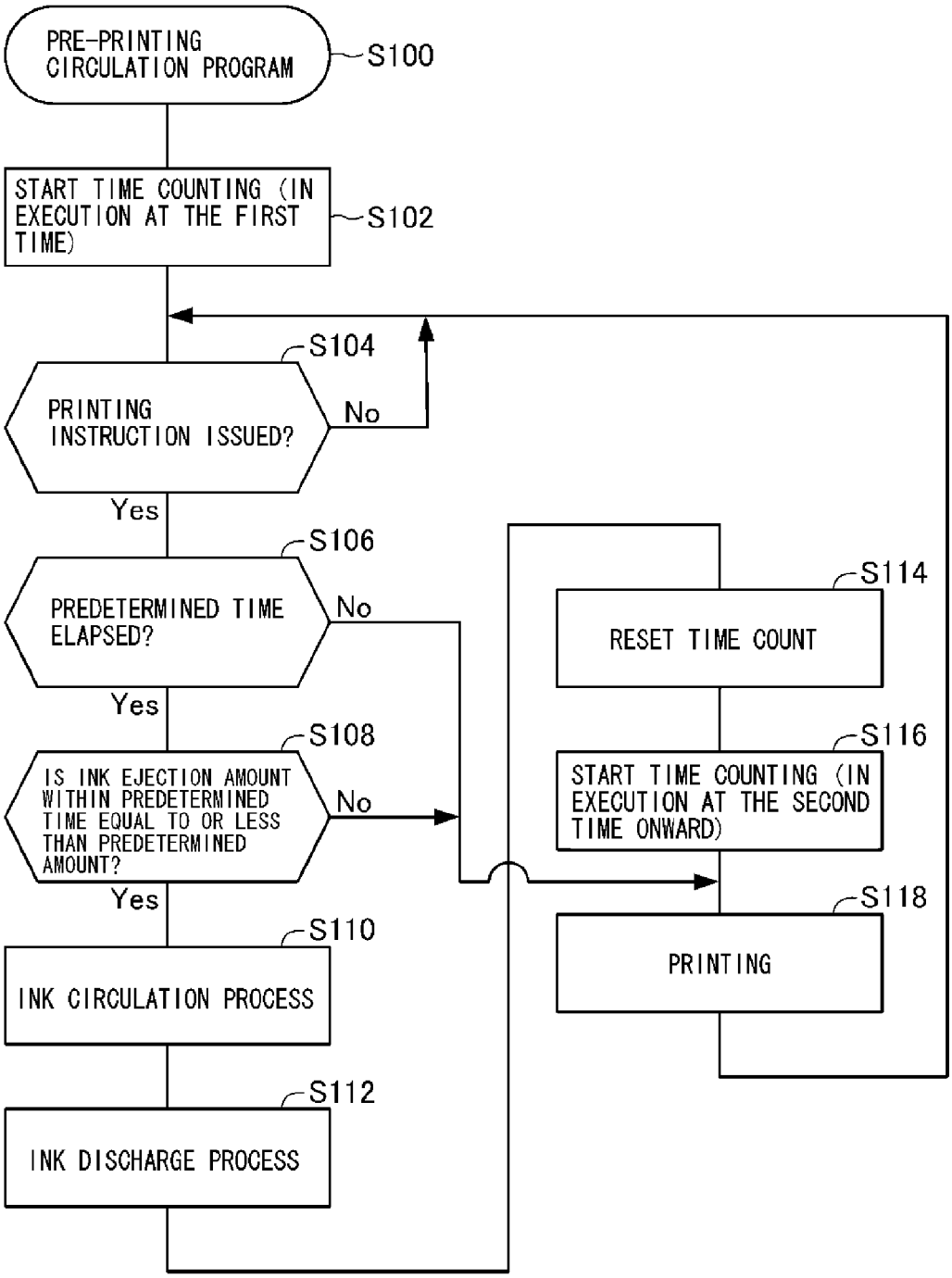
FIG. 3 is a flow-chart illustrating an ink circulation process before printing.
FIG. 4 is a table illustrating the relationship between pump non-operating time and ink discharge amount.

As illustrated in FIG. 3, the controller 120 starts a computer program for performing the pre-printing ink circulation process, that is, a pre-printing circulation program, at step S100. Next, at step S102, the controller 120 starts time counting, that is, measuring of elapsed time. When printing is carried out at the first time after turning ON the main power of the inkjet printer 100, i.e., the primary power supply, the elapsed time after turning the main power ON is measured in this time counting.

The term "printing" used herein means printing using a specific ink. The term "printing" used in steps S104, S118, and so forth likewise means the same. In the case of printing using only an ink other than the specific ink, this pre-printing ink circulation process is not carried out. In such printing, the printing is started without performing the ink circulation process. The specific ink means an ink containing a coloring material that easily settles over time. Examples of the specific ink include white ink, and metallic ink such as silver ink. In the present embodiment, the just-described specific ink is only the white ink. The coloring material of ink refers to a substance that serves the coloring of the ink, and examples include pigments such as titanium oxide in white ink and nickel in yellow ink.

Next, at step S104, the controller 120 determines whether or not there is an instruction indicating the printing using the specific ink. Normally, this instruction for the printing is given from the computer 130 after the user places the recording medium WK on the platen 101. Specifically, the controller 120 determines whether or not there exists an image using the specific ink among the image data that has been input from the computer 130. If the result of the determination at step S104 is YES, the process proceeds step S106, and if NO, the process returns to step S104.

At step S106, the controller 120 determines whether or not a predetermined time has elapsed. If the printing is not yet performed from the time when the main power is turned on, the controller 120 determines whether or not a predetermined time has elapsed since the main power was turned ON. This predetermined time is a time period for which the settling amount of the coloring material contained in the ink is assumed to have reached a level at which it has an adverse effect on the subsequent printing operation, and the predetermined time is set as appropriate depending on the type of the ink. In the present embodiment, the predetermined time is set at 8 hours. If the result of the determination at step S106 is YES, the process proceeds to step S108. If the result of the determination at step S106 is NO, it is determined that the ink circulation process is unnecessary, so the process proceeds to step S118 to perform the printing.

At step S108, the controller 120 determines whether or not the ejection amount of the specific ink within a predetermined time is equal to or less than a predetermined amount. It should be noted that the ejection of ink is carried out not only at the time of the printing onto the recording medium WK but also at the time of cleaning and flushing of the ink head 110. The predetermined time in step S108 and the predetermined time in step S106 may either be the same or different from each other. In the present embodiment, the predetermined time in step S108 is also set at 8 hours, as in step S106. The just-mentioned predetermined amount may be set as appropriate depending on the type of the ink. Generally, the greater the ink ejection amount, the more difficult the settling of the coloring material of the ink occurs in the ink supply tube 112. In the present embodiment, the predetermined amount is set at 7.5 cc. Accordingly, if the ink ejection amount from the ink head 110 is 7.5 cc or less at the time when 8 hours has elapsed since the main power was turned ON, the controller 120 determines that it is highly likely that the coloring material of the ink has settled in the ink supply tube 112, and the process proceeds to step S110. On the other hand, if the ink ejection amount from the ink head 110 is greater than 7.5 cc, the controller 120 determines that it is unlikely that the coloring material of the ink has settled in the ink supply tube 112, and the process proceeds to step S118 to perform the printing.

At step S110, the controller 120 executes the ink circulation process for a predetermined time. Specifically, the controller 120 switches the three-way valves 114*a* and 114*b* to allow the ink supply tube 112 and the ink return tube 115 to communicate with each other. Also, the controller 120 drives the pump 116 for a predetermined time. Thereby, the ink inside the ink supply tube 112 between the three-way valve 114*a* and the three-way valve 114*b* circulates through the ink supply tube 112 and the ink return tube 115 for the predetermined time. The predetermined time here means a time period in which it is assumed that the coloring material of the ink settling in the ink supply tube 112 has been stirred and the settling state has been lost to such a degree that it does not adversely affect the subsequent printing. The predetermined time may be determined based on, for example, the type of composition of the ink, the inner diameter of the ink supply tube 112, and the flow rate of the ink during the circulation. In the present embodiment, the predetermined time is set at 40 seconds. As a result of the ink circulation in step S110, the ink inside the ink supply tube 112 is stirred, and the settling of the coloring material is eliminated.

The timing of starting the ink circulation process may be set as appropriate. In the present embodiment, this ink circulation process is started immediately after the printing instruction is given from the computer 130 to the inkjet printer 100. Specifically, this ink circulation process is started several-ten seconds, for example, about 50 seconds before the starting of the printing by the inkjet printer 100. Also, the ink circulation process is continued until the starting of the printing with the white ink, for example, until about 10 seconds before the white ink starts to be ejected from the ink head 110. In this way, it is desirable that the ink circulation process be completed immediately before the starting of the printing with the white ink (for example, several ten seconds before to several seconds before). It is, however, also possible to continue the ink circulation process until after the printing with the white ink has been started. For example, the ink circulation process may be continued for several seconds after the printing with the white ink has been started.

After the controller 120 has performed the ink circulation process of step S110, the process proceeds to step S112 to perform an ink discharge process. Specifically, the controller 120 switches the three-way valves 114*a* and 114*b* to cut off the communication between the ink supply tube 112 and the ink return tube 115 and allows the ink tank 113 and the ink head 110 to communicate with each other through the ink supply tube 112. Also, the controller 120 stops the pump 116. Then, the controller 120 causes a predetermined amount of ink to be discharged from the ink head 110 to the cleaning unit 117. The ink discharged from the ink head 110 is collected by the cleaning unit 117 and thereafter stored in the waste liquid tank 119.

As illustrated in FIG. 4, in the present embodiment, the predetermined amount is determined according to the length of the time measured in the time counting that has been started at step S102. In the printing at the first time from the main power is turned ON, the predetermined amount is set according to the time from when the main power of the inkjet printer 100 is turned ON to when the printing instruction is issued. The just-mentioned time is, in other words, a time period in which the main power is in an ON state but the pump 116 is not being operated, or printing with an ink other than the specific ink is being performed. Specifically, if the measured time in the time counting is 72 hours or longer, 9 cc of ink is discharged from the ink head 110. This is the total amount of the ink that exists in the location where the ink is not stirred by the ink circulation process, and specifically, it is the amount of the ink that exists in the region from the three-way valve 114*b* to the ink head 110. If the measured time is shorter than 72 hours, the ink is discharged from the ink head 110 in an amount less than 9 cc according to the measured time.

This makes it possible to forcibly discharge a portion or all of the ink existing in the location in which the ink cannot be stirred by the above-described ink circulation process and to thereby prevent the adverse effect of such ink on printing. Moreover, it is possible to prevent adherence of the ink to, for example, the flow passage (not shown) within the ink head 110 and the nozzles. Furthermore, in the present embodiment, the ink discharge amount is changed as appropriate depending on the above-described measured time, so the ink discharge amount will be an amount according to the degree of the settling of the coloring material of the ink. As a result, insufficient ink discharge and excessive ink discharge can be prevented, so the ink discharge can be carried out economically and effectively. Of course, it is also possible to set the ink discharge amount irrespective of the measured time. For example, the ink discharge amount may be set at a fixed amount irrespective of the measured time.

In the present embodiment, the ink discharge process of step S112 is executed immediately after the ink circulation process of step S110 has ended, and it is completed several seconds before the starting of the printing with the white ink. It is, however, also possible that the ink discharge process may be carried out while the pump 116 is being driven, that is, while the ink circulation process is being executed. In this case, it is desirable that the three-way valves 114*a* and 114*b* should be replaced with three-way joints that connect the ink supply tube 112 and the ink return tube 115 to each other so as to be constantly in communication with each other, and the ink should be supplied from the ink tank 113 through the ink supply tube 112 to the ink head 110 when performing the ink discharge process.

When the ink discharge process of step S112 finishes, the process proceeds to step S114 wherein the controller 120 resets the time count. In other words, the measured time is temporarily returned to zero. Subsequently, at step S116, the controller 120 starts a new time count. In other words, the controller 120 restarts measuring of elapsed time. In the time counting for the second time onward that is started in step S116, the elapsed time from the time when the inkjet printer 100 has completed the ink discharge process is measured. The start of the time counting in step S116 becomes the starting point of the predetermined time periods in the subsequent steps S106, S108, and S112.

After step S116, the process proceeds to step S118 wherein the controller 120 performs printing. In other words, the controller 120 prints an image onto the recording medium WK based on image data output from the computer 130. When the controller 120 finishes the printing, the process returns to step S104. The process of step S104 onward is the same as that described above, and is therefore not further elaborated upon.

In the time counting for the second time onward, if the condition in which the printing with the specific ink is not performed continues for a predetermined time (for example, 8 hours) after the time counting has been started at step S116, it is determined that the result is YES at step S106, and the process proceeds to step S108. Here, the phrase "the condition in which the printing with the specific ink is not performed" means to include a condition in which printing using only the inks other than the specific ink is performed, in addition to a condition in which printing is stopped.

The pre-printing ink circulation process is as has just been described. It should be noted that the pre-printing circulation program is executed continuously by the controller 120 while the main power of the inkjet printer 100 is kept turned ON. Thereby, when it is highly likely that the coloring material of ink settles in the ink supply tube 112, the settling of the coloring material can be eliminated prior to printing. In the present embodiment, both the processes of step S106 and step S108 are performed, but it is also possible to eliminate either or both of these steps. The ink circulation process and the ink discharge process may be carried out at all times before printing is started.

Figure 5:
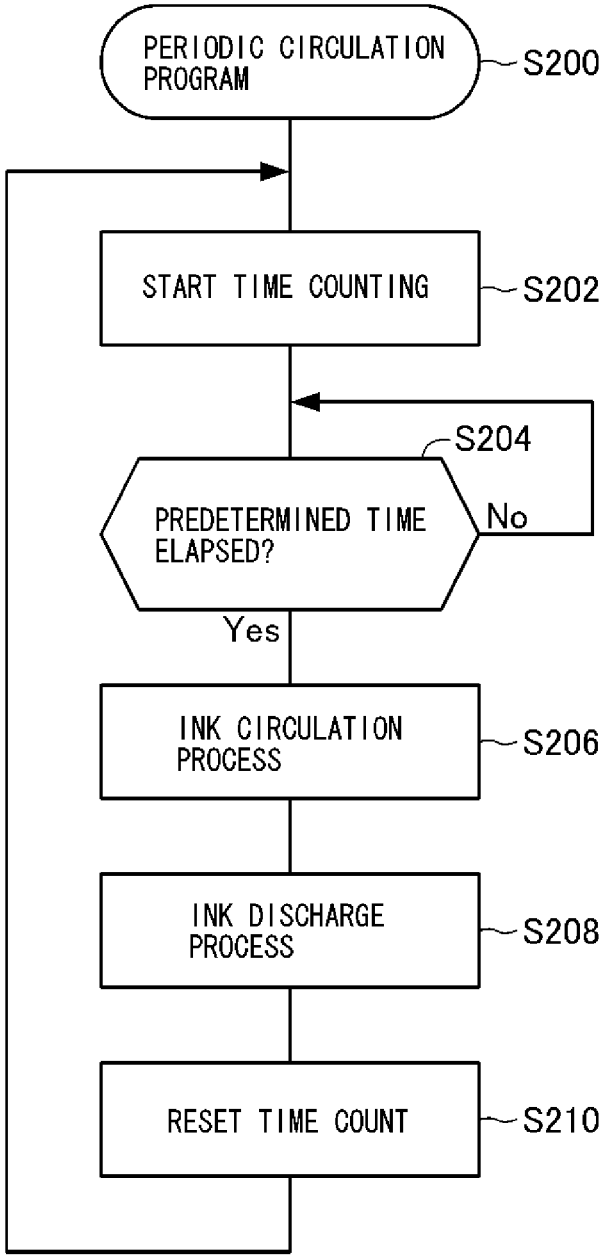
FIG. 5 is a flow-chart illustrating a periodic ink circulation process.

In addition to the above-described pre-printing ink circulation process, the controller 120 executes the following periodic ink circulation process. Next, referring to FIG. 5, the periodic ink circulation process will be described.

First, the controller 120 starts a computer program for performing the periodic ink circulation process, that is, a periodic circulation program, at step S200. Next, at step S202, the controller 120 starts time counting. When the main power of the inkjet printer 100 is turned ON, the elapsed time from when the main power is turned ON is measured. Next, at step S204, the controller 120 determines whether or not predetermined time has elapsed since the time counting was started. This predetermined time is also a time period for which the settling amount of the coloring material contained in the ink in the ink supply tube 112 is assumed to have reached a level at which it has an adverse effect on the subsequent printing operation, and the predetermined time is set at 8 hours in the present embodiment. If the result of the determination at step S204 is YES, the process proceeds step S206, and if NO, the process returns to step S204.

At step S206, the controller 120 executes an ink circulation process. The ink circulation process at this step is the same as that of step S110, and is therefore not further elaborated upon.

After finishing step S206, the process proceeds to step S208 wherein the controller 120 performs an ink discharge process. The ink discharge process at this step is substantially the same as that of the above-described step S112, and is therefore not further elaborated upon. However, in the ink discharge process of step S208, the ink is mainly discharged in an amount corresponding to the ink amount existing in the ink head 110. In the present embodiment, 1.6 cc of the ink is discharged from the ink head 110.

After step S208, the controller 120 resets the time count at step S210. That is, the controller 120 temporarily returns the measured elapsed time to zero. Then, the process returns to step S202, and the controller 120 restarts time counting. Thereafter, the process of step S204 onward is repeated.

The periodic ink circulation process is as has just been described. The periodic circulation program is executed continuously while the main power of the inkjet printer 100 is kept turned ON. This periodic ink circulation process allows the ink circulation process and the ink discharge process to be carried out every time a certain time has elapsed, irrespective of whether the printing operation is performed or not.

Thus, the inkjet printer 100 according to the present embodiment enables the ink in the ink supply tube 112 to circulate through the ink return tube 115. Therefore, even if the coloring material of the ink settles in the ink supply tube 112, the setting state can be eliminated. As a result, it is made possible to inhibit the degradation of the printing quality resulting from the settling of the coloring material of the ink in the ink supply tube 112.

The present invention is not limited to the foregoing embodiments, but may be embodied in various other forms.

For example, in the foregoing embodiment, the pump 116 is provided for the ink return tube 115. However, the position of the pump 116 is not limited to the position described in the foregoing embodiment, as long as it can circulate ink through the ink supply tube 112 and the ink return tube 115. The pump 116 may be provided for the ink supply tube 112. The number of pumps 116 is not limited to one. For example, as indicated by the dashed-line circle in FIG. 2, it is possible to provide a pump 116' for the ink supply tube 112, in place of, or in addition to, the pump 116.

In the foregoing embodiment, the controller 120 executes both the pre-printing circulation program and the periodic circulation program. However, the controller 120 may execute only one of the pre-printing circulation program and the periodic circulation program.

In the foregoing embodiment, the ink discharge process (step S112 and step to S208) is executed after the ink circulation process. However, the ink discharge process is not always necessary, and it is also possible to eliminate the ink discharge process.

In the foregoing embodiment, the time count is reset at the time of completion of the ink discharge process (step S112 and step S208). However, the time count may be reset at the time of completion of the ink circulation process (step S110 and step S206).

The inkjet printer 100 according to the foregoing embodiment uses white, cyan, magenta, yellow, black, and transparent inks. However, the inkjet printer 100 may use other inks. For example, the inkjet printer 100 may use metallic inks such as silver ink, gold ink, and so forth. These kinds of inks also contain a coloring material that easily settles. For that reason, it is preferable that the ink supply systems for such inks be provided with the ink return tube 115, the pump 116, and the three-way valves 114*a* and 114*b*, and the pre-printing or periodic ink circulation process be performed.

In the inkjet printer 100 according to the foregoing embodiment, the ink return tube 115 and so forth are provided only for the ink supply system for white ink among the plurality of the ink supply systems. In other words, the ink return tube 115 and so forth are provided for only one ink supply system. However, it is also possible that the ink return tube 115 and so forth may be provided for a plurality of ink supply systems, and the above-described pre-printing or periodic ink circulation process may be performed in each of the ink supply systems. In this case, the conditions of the ink circulation process or the ink discharge process may be set for one ink supply system to another depending on the type of the ink. The ink circulation process or the ink discharge process may be performed independently from one ink supply system to another. Alternatively, when a predetermined condition is met in any one of the ink supply systems, the ink circulation process or the ink discharge process may be performed at the same time in a plurality of ink supply systems including the one of the ink supply systems.

In the foregoing embodiment, the sub-tank 111 is provided upstream of the ink head 110. However, the sub-tank 111 is not always necessary and may be eliminated.

In the foregoing embodiment, the three-way valves 114*a* and 114*b* are used. However, it is also possible to use three-way joints that connect the ink supply tube 112 and the ink return tube 115 to each other so as to be constantly in communication with each other in place of the three-way valves 114*a* and 114*b*. With this configuration, it is expected to obtain the same advantageous effects as can be obtained in the foregoing embodiment.

In pre-printing ink circulation process of the foregoing embodiment, the controller 120 executes the ink circulation process just before the printing by the ink head 110. In other words, the controller 120 starts the ink circulation process only the minimum time necessary for completing the ink circulation process and the ink discharge process prior to printing. However, it is sufficient that the ink circulation process should be executed before the printing with the ink, and the timing of executing the process is not limited to just before the printing. The ink circulation process may be executed, for example, 10 minutes, 30 minutes, 60 minutes, or 90 minutes prior to the printing.

In the pre-printing ink circulation process in the foregoing embodiment, the ink circulation process and the ink discharge process are executed when 8 hours has elapsed since the main power is turned ON and the ink ejection amount during that period is 7.5 cc or less. However, in place of this, the ink circulation process and the ink discharge process may be executed immediately when the main power is turned ON. It is also possible to execute the ink circulation process and the ink discharge process immediately when the ink tank 113 is set in the inkjet printer 100.

In the foregoing embodiment, the pre-printing circulation program and the periodic circulation program are stored in the controller 120 of the inkjet printer 100. However, these programs may be stored in an external computer 130. The controller 120 may execute the ink circulation process and the like based on an instruction from the external computer 130. In addition, these programs may be stored in an external storage medium, such as an external memory, a CD-R, and DVD-R. Alternatively, these programs may be downloaded through a communication line such as the internet.

Figure 6:
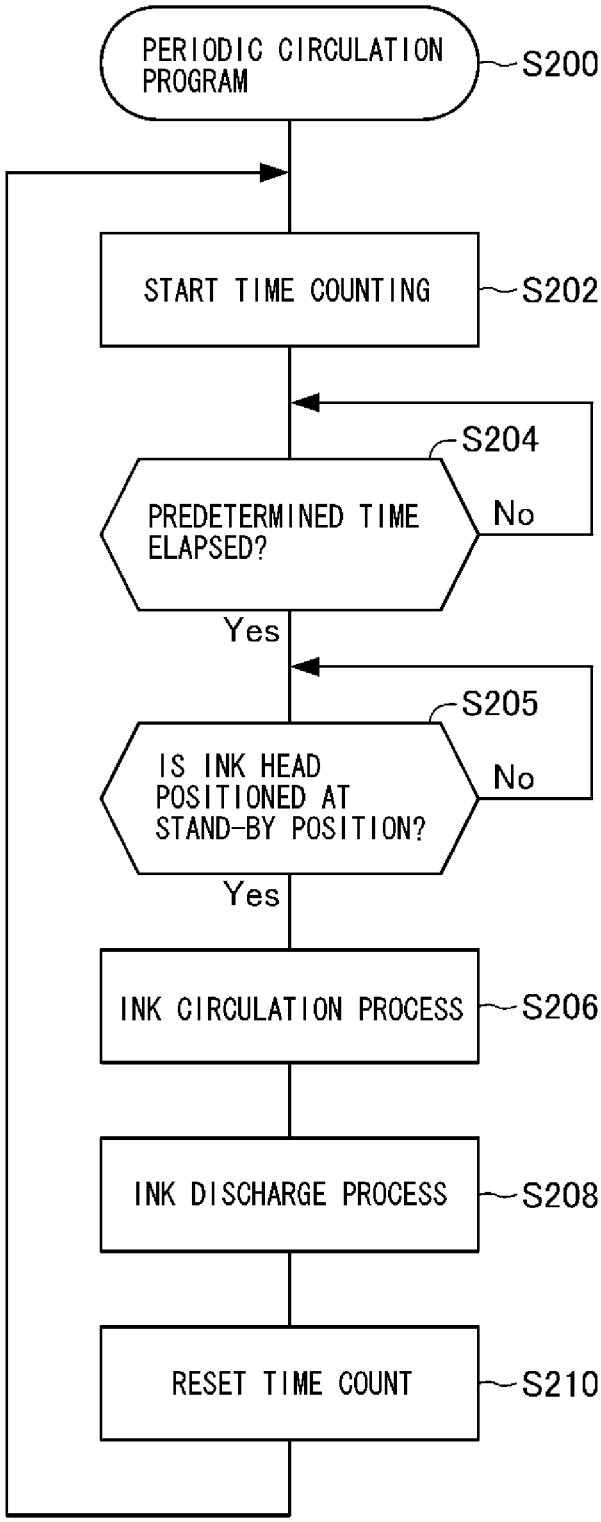
FIG. 6 is a flow-chart illustrating a periodic ink circulation process according to another embodiment.

In the periodic ink circulation process of the foregoing embodiment, there is a case in which it is determined at step S204 that a predetermined time has elapsed while the printing is being executed. In other words, there may be a case in which printing is being carried out when 8 hours has elapsed since the previous ink circulation and ejection processes were completed. In this case, the printing may be interrupted temporarily, and the ink circulation process and the ink discharge process may be carried out. Alternatively, the ink circulation process and the ink discharge process may be suspended until the printing is completed. In other words, the ink circulation process and the ink discharge process may be executed after the printing is completed. For example, as illustrated in FIG. 6, after step 204, the controller 120 determines whether or not the ink head 110 is positioned at the stand-by position, at step S205. During the time when the printing is being carried out, the ink head 110 is not positioned at the stand-by position, so the result of the determination at step S205 is NO. If the result of the determination at step S205 is NO, the process returns to step S205 again. That is, the ink circulation process and the ink discharge process are suspended until the printing is completed and the ink head 110 is positioned at the stand-by position. On the other hand, when the printing is not being carried out, the ink head 110 stands by at the stand-by position, so the result of the determination at step S205 is YES. If the result of the determination at step S205 is YES, the controller 120 executes the process of step S206 onward.

Figure 7:
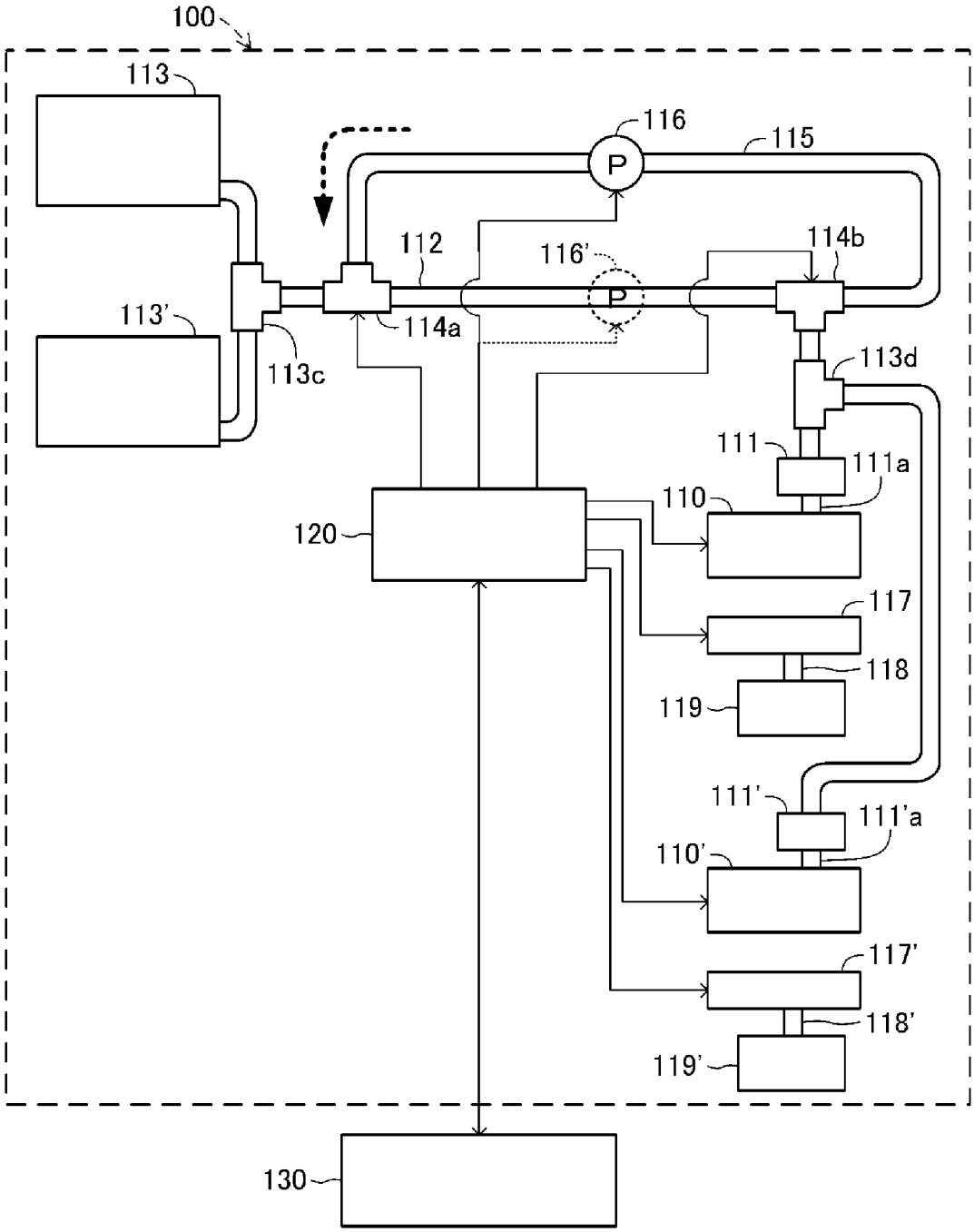
FIG. 7 is a conceptual view illustrating an ink supply system according to another embodiment.

In the foregoing embodiment, the inkjet printer 100 has one ink tank 113, one sub-tank 111, and one ink head 110 for each one of the colors of inks. However, it is possible that a plurality of ink tanks 113, a plurality of sub-tanks 111, and a plurality of ink heads 110 may be provided for each one of the colors of inks. In this case, the ink return tube 115, the pump 116, and the three-way valves 114*a* and 114*b* may be used commonly for the plurality of ink tanks 113, the plurality of sub-tanks 111, and the plurality of ink heads 110. For example, the inkjet printer 100 may have an ink supply system as shown in FIG. 7. In the embodiment shown in FIG. 7, an ink supply tube for guiding ink from an ink tank 113 and an ink supply tube for guiding ink from an ink tank 113' are connected to each other by a three-way joint 113*c*. The port on the flow-out side of the three-way joint 113*c* is connected to the three-way valve 114*a* through another ink supply tube. A three-way joint 113*d* is connected an ink supply tube that connects the three-way valve 114*b* and the sub-tank 111 to each other. The sub-tank 111' is connected to one of the ports of the three-way joint 113*d* via another ink supply tube. In this way, the ink supply tube 112, the ink return tube 115, the pump 116, and the three-way valves 114*a* and 114*b* can be used commonly for the ink tanks 113 and 113', the sub-tanks 111 and 111', and the ink heads 110 and 110'.

Figure 8:
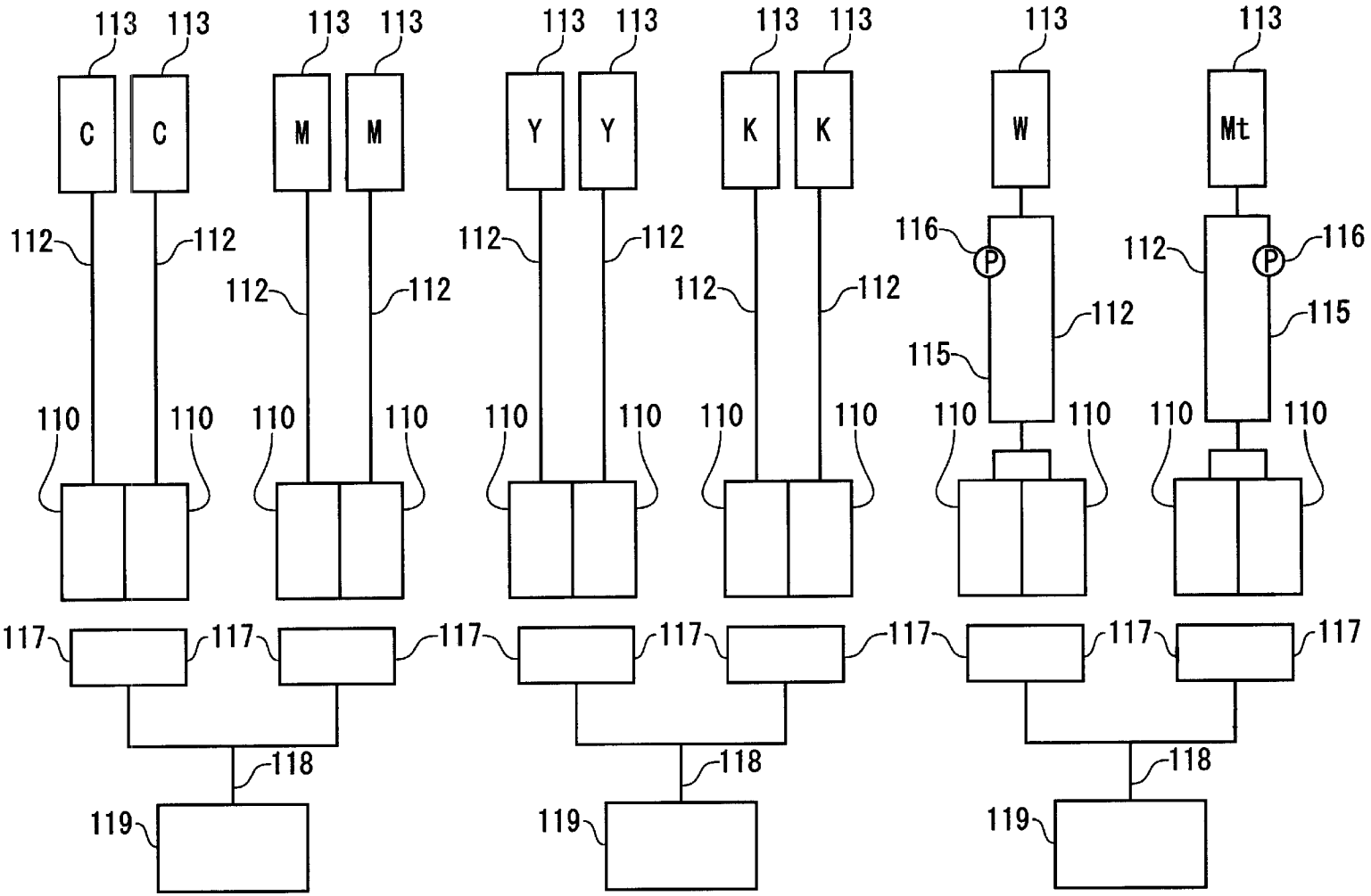
FIG. 8 is a conceptual view illustrating an ink supply system according to yet another embodiment.

The ink tank 113 in addition to the ink return tube 115 and the pump 116 may be used commonly for a plurality of sub-tanks 111 and a plurality of ink heads 110. For example, the inkjet printer 100 may have an ink supply system as shown in FIG. 8. In the embodiment shown in FIG. 8, two respective ink heads 110 are provided per each one of cyan, magenta, yellow, black, white, and metallic inks in the inkjet printer 100. In the figure, the characters C, M, Y, K, W, and Mt respectively represent cyan, magenta, yellow, black, white, and metallic. For each of cyan, magenta, yellow, and black inks, one ink tank 113 is provided per each one ink head 110. The ink supply systems for these inks are not provided with the ink return tube 115. For each of white and metallic inks, one ink tank 113 is provided per two ink heads 110. In addition, for each of white and metallic inks, one ink supply tube 112, one ink return tube 115, and one pump 116 are used commonly for the two ink heads 110. It should be noted that the ink supply tube 112 and the ink return tube 115 may be connected to each other via either a three-way valve or a three-way joint.

The invention claimed is:

1. An inkjet recording device comprising:

an ink tank configured to store ink;

an ink head configured to eject the ink;

an ink supply path having an upstream end connected to the ink tank and a downstream end connected to the ink head, the ink supply path connecting the ink tank and the ink head to each other;

an ink return path, one end of which being connected to the ink supply path by a three-way valve or a three-way joint at a location nearer the upstream end than a mid-position of the ink supply path and the other end of which being connected to the ink supply path by a three-way valve or a three-way joint at a location nearer the downstream end than the mid-position of the ink supply path; and a pump configured to circulate the ink through the ink supply path and the ink return path.

2. The inkjet recording device according to claim 1, further comprising:

a control device configured to control the ink head and the pump, and wherein the control device drives the pump before the ink head ejects the ink to perform printing.

3. The inkjet recording device according to claim 1, further comprising:

a control device configured to control the ink head and the pump, and wherein the control device drives the pump after a predetermined time has elapsed since the ink head completed ejecting of the ink.

4. The inkjet recording device according to claim 1, further comprising a control device configured to drive the pump each time a predetermined time has elapsed.

5. The inkjet recording device according to claim 1, further comprising:

a control device configured to control the ink head and the pump, and wherein the control device allows the ink head to discharge a predetermined amount of ink after driving the pump and before starting printing by the ink head.

6. The inkjet recording device according to claim 5, wherein the control device sets the predetermined amount according to a time period from completion of printing by the ink head to start of subsequent printing.

7. The inkjet recording device according to claim 1, further comprising:

a control device configured to control the ink head and the pump, and wherein the control device allows the ink head to discharge a predetermined amount of ink after driving the pump and before starting printing by the ink head, and wherein the control device sets the predetermined amount according to a time period in which driving of the pump is stopped.

8. The inkjet recording device according to claim 1, wherein the pump is provided in the ink return path.

9. An inkjet recording device comprising:

an ink tank configured to store ink;

an ink head configured to eject the ink;

an ink supply path having an upstream end connected to the ink tank and a downstream end connected to the ink head, the ink supply path connecting the ink tank and the ink head to each other;

an ink return path, one end of which being connected to the ink supply path at a location nearer the upstream end than a mid-position of the ink supply path and the other end of which being connected to the ink supply path at a location nearer the downstream end than the mid-position of the ink supply path;

a pump configured to circulate the ink through the ink supply path and the ink return path;

a control device configured to control the ink head and the pump, wherein the control device drives the pump when an ink ejection amount from the ink head within a predetermined time is equal to or less than a predetermined amount.

10. The inkjet recording device according to claim 9, wherein the control device is configured to drive the pump each time a predetermined time has elapsed.

* * * * *